US008505506B2

(12) United States Patent
Miyachi et al.

(10) Patent No.: US 8,505,506 B2
(45) Date of Patent: Aug. 13, 2013

(54) OIL PRESSURE CONTROL APPARATUS

(75) Inventors: Eiji Miyachi, Nishio (JP); Yasuo Ozawa, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 258 days.

(21) Appl. No.: 13/020,542

(22) Filed: Feb. 3, 2011

(65) Prior Publication Data

US 2011/0232594 A1 Sep. 29, 2011

(30) Foreign Application Priority Data

Mar. 23, 2010 (JP) ..... 2010-066563

(51) Int. Cl.
*F01L 1/34* (2006.01)

(52) U.S. Cl.
USPC ..... 123/90.17; 123/90.12; 123/90.15; 123/90.16; 123/90.34; 123/196 M; 123/196 R; 417/279; 417/364; 464/160; 251/22; 251/325

(58) Field of Classification Search
USPC ..... 123/90.12, 90.15, 90.16, 90.17, 90.34, 123/196 M, 196 R; 417/279, 364; 464/160; 251/22, 325
See application file for complete search history.

(56) References Cited

U.S. PATENT DOCUMENTS

| | | | |
|---|---|---|---|
| 4,452,188 | A | 6/1984 | Kosuda et al. |
| 6,202,610 | B1 | 3/2001 | Yoshiki et al. |
| 2002/0062803 | A1 | 5/2002 | Sato et al. |
| 2009/0311115 | A1 | 12/2009 | Ono et al. |

FOREIGN PATENT DOCUMENTS

| | | | |
|---|---|---|---|
| DE | 100 04 823 | A1 | 8/2000 |
| EP | 2 133 517 | A1 | 12/2009 |
| JP | 2009-41445 | A | 2/2009 |
| JP | 2009-299573 | A | 12/2009 |

OTHER PUBLICATIONS

U.S. Appl. No. 12/870,422 naming Eiji Miyachi and Hisashi Ono as inventors and filed on Aug. 27, 2010.*
Extended European Search Report issued Mar. 13, 2013 by the European Patent Office in European Application No. 11153067.1 (4 pages).

* cited by examiner

*Primary Examiner* — Kenneth Bomberg
*Assistant Examiner* — Jason T Newton
(74) *Attorney, Agent, or Firm* — Buchanan Ingersoll & Rooney PC

(57) ABSTRACT

An oil pressure control apparatus includes a control valve mechanism being in communication with a pump via a first fluid passage and being in communication with a control apparatus via a second fluid passage, a third fluid passage diverging from the first fluid passage to supply oil to a predetermined portion other than the control apparatus, and a fluid passage dimension regulating mechanism including a movable member provided at the third fluid passage and including an opening for regulating a fluid passage dimension of the third fluid passage. The fluid passage dimension regulating mechanism is in communication with a fourth fluid passage diverging from the second fluid passage and biases the movable member to a side increasing the fluid passage dimension by applying the hydraulic pressure of the fourth fluid passage to the movable member separately from the hydraulic pressure of the third fluid passage.

17 Claims, 7 Drawing Sheets

OIL PRESSURE CONTROL APPARATUS

CROSS REFERENCE TO RELATED APPLICATIONS

This application is based on and claims priority under 35 U.S.C. §119 to Japanese Patent Application 2010-066563, filed on Mar. 23, 2010, the entire content of which is incorporated herein by reference.

TECHNICAL FIELD

This disclosure relates to an oil pressure control apparatus.

BACKGROUND DISCUSSION

A known oil pressure control apparatus is disclosed in JP2009-299573A (hereinafter referred to as Patent reference 1). The oil pressure control apparatus disclosed in Patent reference 1 includes a control apparatus (i.e., a valve timing control apparatus) and an engine lubrication apparatus. The control apparatus includes a pump (i.e., an oil pump) driven by a rotation of an engine to discharge the oil, a driving side rotation member (i.e., outer rotor) rotating synchronous to a crankshaft, and a driven side rotation member (i.e., inner rotor) arranged coaxially with the driving side rotation member to synchronously rotate with a camshaft, and controls a timing for opening/closing a valve by changing a relative rotational phase of the driven side rotation member relative to the driving side rotation member by supplying and discharging the oil. The engine lubrication apparatus is configured to lubricate each portion of the engine by the application of the oil supplied by means of the pump.

The oil pressure control apparatus disclosed in Patent reference 1 includes a priority valve which restricts a flow amount of the oil from the pump to the engine lubrication apparatus and prioritizes the supply of the oil from the pump to the valve timing control apparatus when a hydraulic pressure applied to the control apparatus is lower. Thus, when the rotation speed of the pump is lower, the hydraulic pressure applied to the valve timing control apparatus is ensured on a priority basis, and the valve timing control apparatus is appropriately operated without an electric pump which assists the operation of the pump.

In those circumstances, notwithstanding, the oil pressure control apparatus disclosed in Patent reference 1 controls the priority valve with an oil switching valve (i.e., opening/closing valve) which is configured to operate in response to a driving state of the engine to selectively supply the oil to a pressure increasing mechanism. Accordingly, in a case where the oil pressure control apparatus disclosed in Patent reference 1 is actually mounted to the vehicle, a manufacturing cost may increase.

A need thus exists for an oil pressure control apparatus which is not susceptible to the drawback mentioned above.

SUMMARY

In light of the foregoing, the disclosure provides an oil pressure control apparatus, which includes a pump driven by a rotation of a driving power source for discharging an oil, a control apparatus including a driving side rotation member rotating synchronously to a crankshaft and a driven side rotation member arranged coaxially to the driving side rotation member and rotating synchronously to a camshaft, the control apparatus controlling an opening/closing timing of a valve by displacing a relative rotational phase of the driven side rotation member relative to the driving side rotation member by supplying or discharging the oil, a control valve mechanism being in communication with the pump via a first fluid passage and being in communication with the control apparatus via a second fluid passage for controlling to supply and discharge the oil relative to the control apparatus, a third fluid passage diverging from the first fluid passage to supply the oil to a predetermined portion other than the control apparatus, and a fluid passage dimension regulating mechanism including a movable member provided at the third fluid passage and including an opening for regulating a fluid passage dimension of the third fluid passage, the movable member being biased to a side for increasing the fluid passage dimension by an application of an hydraulic pressure of the third fluid passage. The fluid passage dimension regulating mechanism is in communication with a fourth fluid passage diverging from the second fluid passage and biases the movable member to the side increasing the fluid passage dimension by applying the hydraulic pressure of the fourth fluid passage to the movable member separately from the hydraulic pressure of the third fluid passage.

According to another aspect of the disclosure, an oil pressure control apparatus includes a pump driven by a rotation of a driving power source for discharging an oil, an oil pressure actuator driven by a hydraulic pressure of the oil discharged from the pump, a control valve mechanism being in communication with the pump via a first fluid passage and being in communication with the oil pressure actuator via a second fluid passage to control a supply and discharge of the oil relative to the oil pressure actuator, a third fluid passage diverging from the first fluid passage to supply the oil to a predetermined portion other than the oil pressure actuator, and a fluid passage dimension regulating mechanism including a movable member configured to regulate a fluid passage dimension of the third fluid passage. The movable member moves towards a side for increasing the fluid passage dimension of the third fluid passage by an application of at least one of the hydraulic pressure of the third fluid passage and the hydraulic pressure of the fourth fluid passage diverged from the second fluid passage.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of the oil pressure control apparatus, which is adapted to an oil pressure control apparatus for an engine for a vehicle, will be explained with reference to illustrations of drawing figures as follows. According to the embodiment, a valve timing control apparatus provided at an intake valve serves as a control apparatus.

Figure 1:
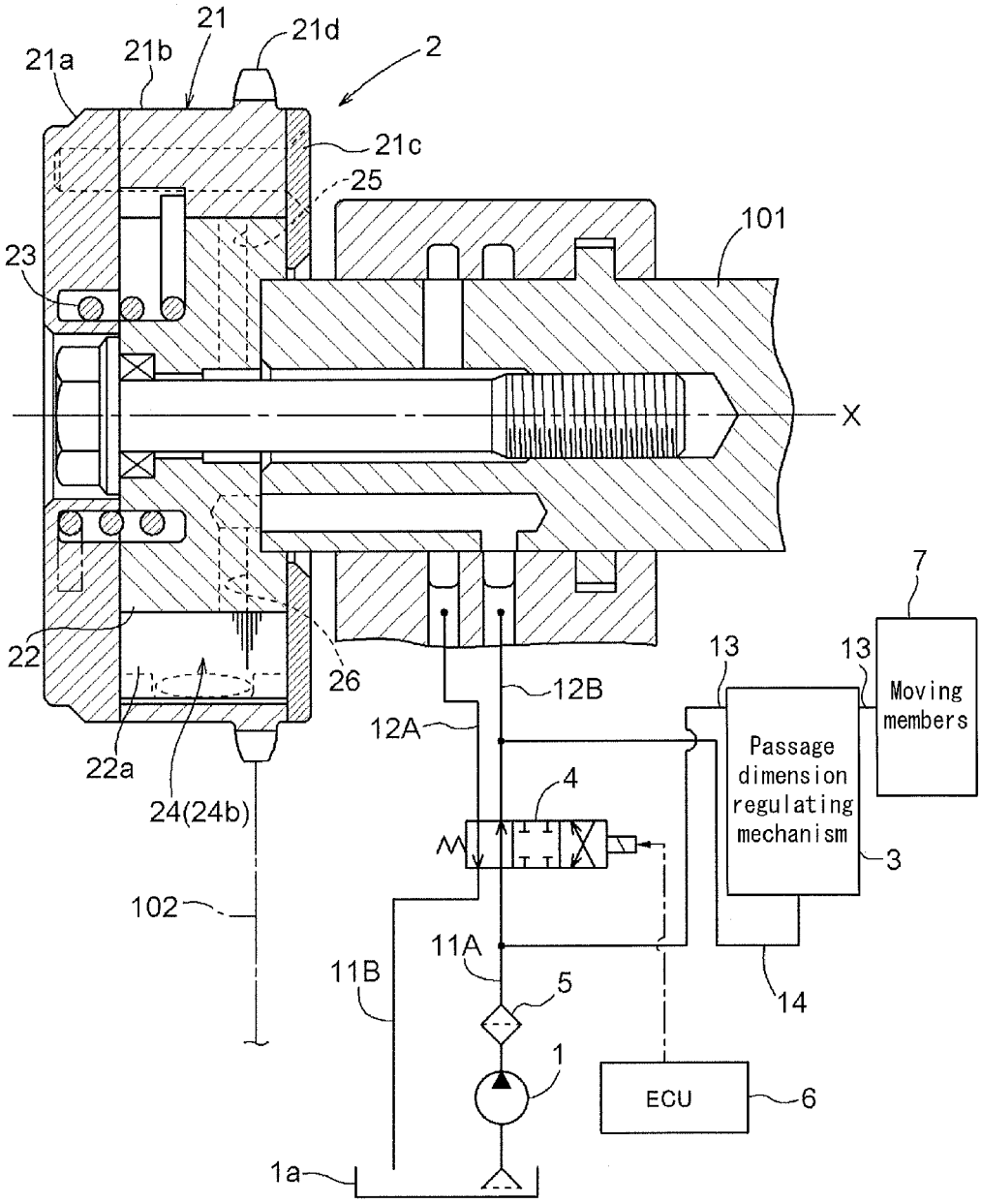
FIG. 1 is an overview of an oil pressure control apparatus according to an embodiment disclosed here.

As shown in FIG. 1, the oil pressure control apparatus includes a pump 1 driven by a rotation of an engine, a valve timing control apparatus (VVT) 2 serving as a control apparatus which changes a relative rotational phase of a driven side rotation member relative to a driving side rotation member by supplying or discharging the oil, and an oil control valve (OCV) 4 serving as a control valve mechanism for controlling the supply and the discharge of the oil to the valve timing control apparatus 2. The pump 1 and the OCV 4 are connected via a discharging fluid passage 11A serving as a first passage. The valve timing control apparatus 2 and the OCV 4 are connected via a retarded angle fluid passage 12B serving as a second passage. A lubrication fluid passage 13 serving as a third passage for supplying the oil to moving members 7 to which the oil is supplied via a main gallery (i.e., the moving members 7 serving as a predetermined portion other than the control apparatus) diverges from the discharging fluid passage 11A. A passage dimension regulating mechanism 3 for regulating a size of a passage dimension of the lubrication fluid passage 13 is provided at the lubrication fluid passage 13. An operation fluid passage 14 serving as a fourth fluid passage for supplying the oil to the passage dimension regulating mechanism 3 diverges from the retarded angle fluid passage 12B. The passages (first to fourth passages) are formed on a cylinder case, or the like, of the engine.

Constructions of the pump 1 will be explained hereinafter. A rotational driving force of a crankshaft is transmitted to mechanically drive the pump 1 to discharge the oil. As shown in FIG. 1, the pump 1 sucks the oil reserved in an oil pan 1*a* and discharges the reserved oil to the discharging fluid passage 11A. An oil filter 5 is provided in the discharging fluid passage 11A to filter off sludge or dust, or the like, which is not filtered off by an oil strainer. The oil filtered by the oil filter 5 is supplied to the valve timing control apparatus 2 and the moving members 7 via the OCV 4. The moving members 7 (i.e., serving as the predetermined portion other than the control apparatus) correspond to moving members including a piston, a cylinder, a bearing of the crankshaft, or the like.

The oil discharged from the valve timing control apparatus 2 returns to the oil pan 1*a* via the OCV 4 and a return passage 11B. The oil supplied to the moving members 7 is collected to be reserved in the oil pan 1*a* via a cover member, or the like. Further, the oil leaked from the valve timing control apparatus 2 is collected to be reserved in the oil pan 1*a* via the cover member, or the like.

Constructions of the valve timing control apparatus 2 will be explained hereinafter. As shown in FIG. 1, the valve timing control apparatus 2 includes a housing 21 serving as the driving side rotation member synchronously rotating with the crankshaft of the engine, and an inner rotor 22 serving as the driven side rotation member which is arranged coaxially to the housing 21 and rotates synchronous to a camshaft 101. The valve timing control apparatus 2 includes a lock mechanism 27 which is configured to restrict the relative rotational phase of the inner rotor 22 to the housing 21 at a most retarded angle phase.

Constructions of the housing 21 and the inner rotor 22 will be explained in more details as follows. As shown in FIG. 1, the inner rotor 22 is assembled to an end portion of the camshaft 101. The housing 21 includes a front plate 21*a* provided at a side opposite to a side to which the camshaft 101 is connected, an outer rotor 21*b* integrally including a timing sprocket 21*d*, and a rear plate 21*c* provided at the side to which the camshaft 101 is connected. The outer rotor 21*b* is fitted to an outer periphery of the inner rotor 22. The outer rotor 21*b* and the inner rotor 22 are sandwiched by the front plate 21*a* and the rear plate 21*c*. The front plate 21*a*, the outer rotor 21*b*, and the rear plate 21*c* are fastened by bolts.

Figure 2:
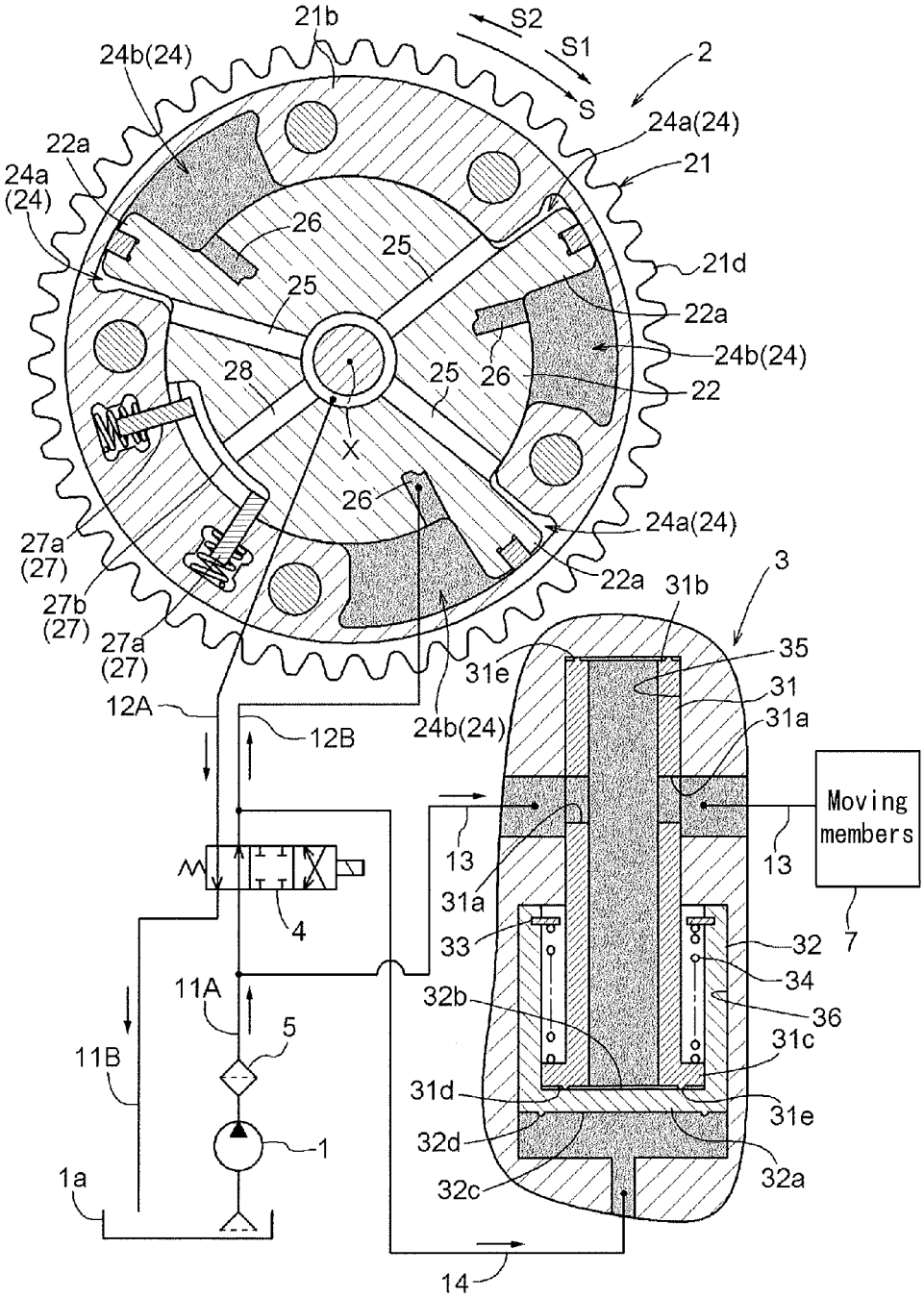
FIG. 2 is a cross-sectional view of the oil pressure control apparatus when an oil temperature is lower than a first predetermined temperature or higher than a second predetermined temperature.

Upon the rotation of the crankshaft, the rotational driving force of the crankshaft is transmitted to the timing sprocket 21*d* via a power transmission member 102 to rotate the housing 21 in a rotational direction S shown in FIG. 2. In response to the rotation of the housing 21, the inner rotor 22 rotates in the rotational direction S to rotate the camshaft 101, and thus a cam provided at the camshaft 101 pushes an intake valve of the engine to open the intake valve.

As shown in FIG. 2, according to the embodiment, the outer rotor 21*b* and the inner rotor 22 form plural fluid pressure chambers 24. As illustrated in FIG. 2, plural vanes 22*a* projecting outwardly in a radial direction are formed on the inner rotor 22. The plural vanes 22*a* are formed along the rotational direction S to be separated from each other so that each of the vane 22*a* is positioned in each of the corresponding fluid pressure chambers 24. The fluid pressure chamber 24 is divided into an advanced angle chamber 24*a* and a retarded angle chamber 24*b* by the vane 22*a* along the rotational direction S.

As shown in FIGS. 1 and 2, plural advanced angle chamber communication passages 25 which are configured to communicate with the corresponding advanced angle chambers 24*a* are formed on the inner rotor 22 and the camshaft 101. Further, plural retarded angle chamber communication passages 26 which are configured to communicate with the corresponding retarded angle chambers 24*b* are formed on the inner rotor 22 and the camshaft 101. As shown in FIG. 1, the advanced angle chamber communication passages 25 are connected to an advanced angle fluid passage 12A which is in communication with the OCV 4. The retarded angle chamber communication passages 26 are connected to the retarded angle fluid passage 12B which is in communication with the OCV 4.

As shown in FIG. 1, a torsion spring 23 is provided extending from the inner rotor 22*a* and the front plate 21*a*. The torsion spring 23 biases the inner rotor 22 towards an advancing angle side to be against an average displacing force in a retarded angle direction by a cam torque fluctuation. Accordingly, the relative rotational phase is displaced, or changed in an advanced angle direction S1 smoothly and swiftly.

Constructions of the lock mechanism 27 will be explained in details as follows. The lock mechanism 27 is configured to restrict the relative rotational phase of the inner rotor 22 to the housing 21 to be the most retarded angle phase by maintaining the housing 21 and the inner rotor 22 at a predetermined relative position in a state where a level of the oil pressure is not stabilized immediately after a start of the engine. In consequence, the engine is appropriately started and the inner rotor 22 does not flutter by a displacing force based on a fluctuation of a cam torque at a start of the engine or during an idling operation.

The lock mechanism 27 includes two plate shaped lock members 27*a*, 27*a*, a lock groove 27*b*, and a lock mechanism communication passage 28 as shown in FIG. 2. The lock groove 27*b* is formed on an outer circumferential surface of the inner rotor 22 and has a predetermined width in a relative rotational direction. The lock member 27*a* is disposed in a housing portion formed on the outer rotor 21*b* and is configured to protrude to or retracted from the lock groove 27*b* in a radial direction. The lock member 27*a* is constantly biased inwardly in the radial direction, that is, towards the lock groove 27*b* by a spring. The lock mechanism communication passage 28 connects the lock groove 27*b* and the advanced angle chamber communication passages 25. Accordingly, when the oil is supplied to the advanced angle chamber 24*a*, the oil is supplied to the lock groove 27*b*, and when the oil is discharged from the advanced angle chamber 24*a*, the oil is discharged from the lock groove 27*b*.

Figure 3:
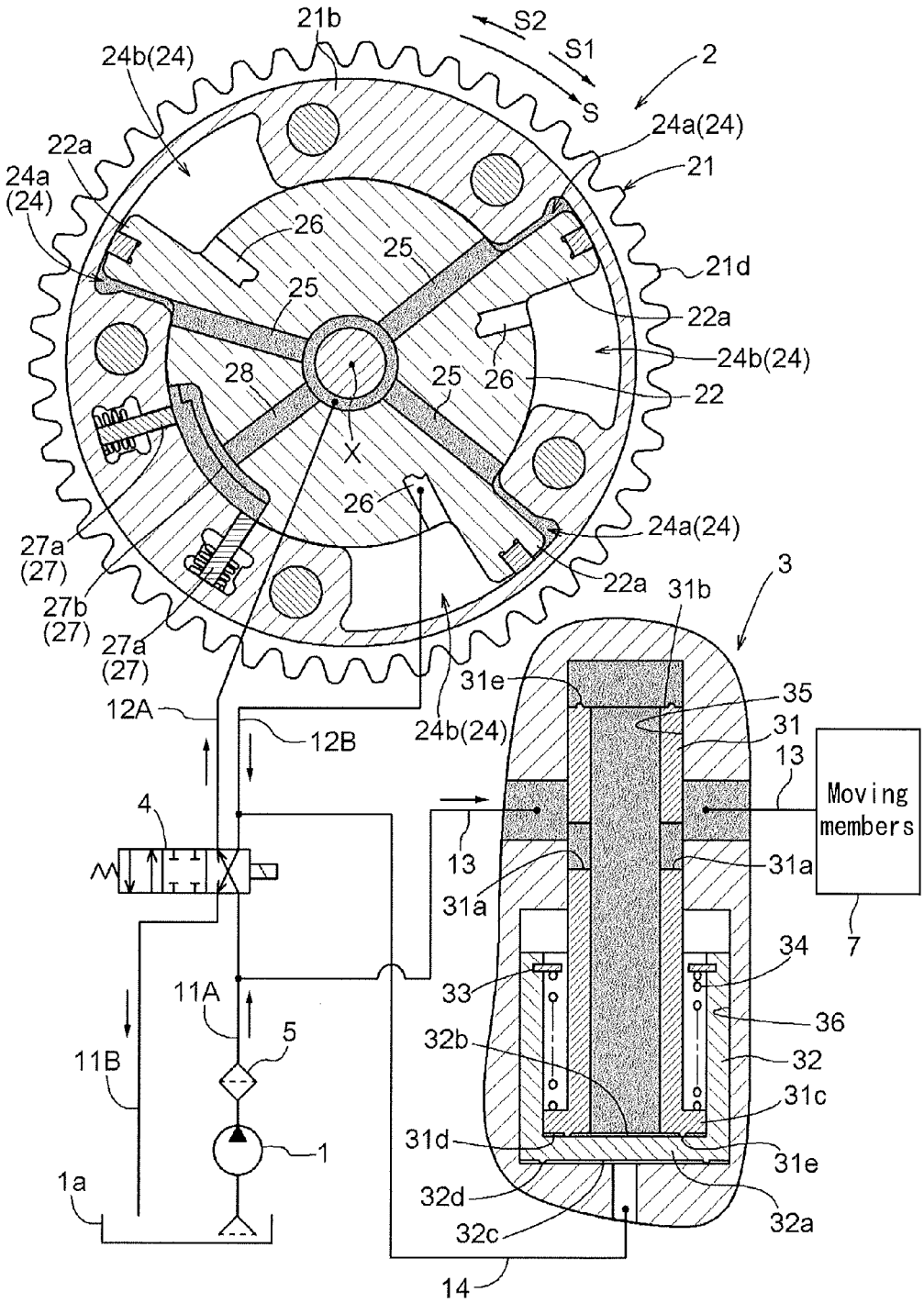
FIG. 3 is a cross-sectional view of the oil pressure control apparatus when the oil temperature is between the first predetermined temperature and the second predetermined temperature and a rotation speed of an engine is relatively low.

When the oil is discharged from the lock groove 27*b*, each of the lock members 27*a* comes to protrude to the lock groove 27*b*. As shown in FIG. 2, when both of the lock members 27*a* protrude into the lock groove 27*b*, each of the lock members 27*a* comes to engage with a corresponding end of the lock groove 27*b* in a circumferential direction simultaneously. In consequence, the relative rotational movement of the inner rotor 22 relative to the housing 21 is restricted and the relative rotational phase is restricted at the most retarded angle phase. When the oil is supplied to the lock groove 27*b*, as shown in FIG. 3, the lock members 27*a*, 27*a* are retracted from the lock groove 27*b* to cancel the restriction of the relative rotational phase, thus the inner rotor 22 comes to rotate as shown in FIG. 3. Hereinafter, a state where the relative rotational phase of the lock mechanism 27 is restricted at the most retarded angle phase is defined as a locked state. Further, a state, where the locked state is canceled, is defined as an unlocked state.

Constructions of the OCV 4 serving as the control valve mechanism will be explained in details as follows. The OCV 4 is an electromagnetic controlling type oil control valve and is configured to control the supply of the oil, the discharge of the oil, and the maintenance of the supply amount of the oil relative to the advancing angle communication passages 25 and the retarded angle chamber communication passages 26. The OCV 4 is operated by an electronic control unit (ECU) 6 by controlling an amount of the electricity to be supplied. The OCV 4 is configured to allow controls for supplying the oil to the advanced angle fluid passage 12A and discharging the oil from the retarded angle fluid passage 12B, for discharging the oil from the advanced angle fluid passage 12A and supplying the oil to the retarded angle fluid passage, and for blocking the supply and discharge of the oil to and from the advanced angle fluid passage 12A and the retarded angle fluid passage 12B. A control for supplying the oil to the advanced angle fluid passage 12A and discharging the oil from the retarded angle fluid passage 12B is defined as an advanced angle control. When the advanced angle control is performed, the vane 22*a* rotates relative to the outer rotor 21*b* in the advanced angle direction S1 to displace the relative rotational phase towards an advanced angle side. A control for discharging the oil from the advanced angle fluid passage 12A and supplying the oil to the retarded angle fluid passage 12B is defined as a retarded angle control. When the retarded angle control is performed, the vane 22*a* rotates relative to the outer rotor 21*b* in a retarded angle direction S2 (see FIG. 2) to displace the relative rotational phase towards a retarded angle side. When a control for restricting, or blocking the supply and discharge of the oil relative to the advanced angle fluid passage 12A and the retarded angle fluid passage 12B, the relative rotational phase is maintained at a desired phase.

When supplying electricity to the OCV 4 (i.e., ON), a state where the advanced angle control can be performed is established. When stopping the supply of the electricity to the OCV 4 (i.e., OFF), a state where the retarded angle control can be performed is established. The OCV 4 is configured to set an opening degree thereof by regulating a duty ratio of the electric power supplied to an electromagnetic solenoid. Accordingly, a slight, or delicate adjustment of the supply and discharge of the oil can be achieved.

By controlling the OCV 4 as explained above, the oil is supplied to the advanced angle chamber 24*a* and the retarded angle chamber 24*b*, the oil is discharged from the advanced angle chamber 24*a* and the retarded angle chamber 24*b*, and the supplying and discharging amount of the oil relative to the advanced angle chamber 24*a* and the retarded angle chamber 24*b* is maintained by controlling the OCV 4, thus applying the oil pressure force to the vane 22*a*. Accordingly, the relative rotational phase is displaced either towards the advanced angle direction or the retarded angle direction, or the relative rotational phase is maintained at a desired positional phase.

Constructions of the valve timing control apparatus 2 will be explained with reference to FIGS. 2 to 5 as follows. According to the constructions explained above, the inner rotor 22 smoothly rotates relative to the housing 21 about a rotational axis X within a predetermined range. The predetermined range in which the housing 21 and the inner rotor 22 relatively rotates to displace, that is, a difference of a phase between the most advanced angle phase and the most retarded angle phase, corresponds to a range that the vane 22*a* displaces inside the fluid pressure chamber 24. A phase at which a volume of the retarded angle chamber 24*b* is assumed to be the maximum corresponds to the most retarded angle phase, and a phase at which a volume of the advanced angle chamber 24*a* is assumed to be the maximum corresponds to the most advanced angle phase.

A crank angle sensor for detecting a rotational angle of a crankshaft of the engine and a camshaft angle sensor for detecting a rotational angle of the camshaft 101 are provided. The ECU 6 detects a relative rotational phase based on detected results by the crank angle sensor and the camshaft angle sensor to determine a state of the relative rotational phase. The ECU 6 includes a signal system for obtaining the ON/OFF information of an ignition key, the information from a fluid temperature sensor for detecting the temperature of the oil, or the like. Further, the control information of an optimum relative rotational phase in accordance with a driving state of the engine is memorized in the ECU 6. The ECU 6 controls the relative rotational phase based on the information of the driving state (e.g., an engine rotation speed, a temperature of a coolant) and the control information mentioned above.

As shown in FIG. 2, the valve timing control apparatus 2 is assumed to be in a locked state by the lock mechanism 27. When the ignition key is turned on, a cranking starts, and the engine starts in a state where the relative rotational phase is restricted at the most retarded angle phase. Then, the engine operation is transited to an idling operation and a catalyst warm-up starts. Upon a completion of the catalyst warm-up and an acceleration pedal is stepped on, the electricity is supplied to the OCV 4 to perform the advanced angle control in order to displace the relative rotational phase in the advanced angle direction S1. Thus, the oil is supplied to the advanced angle chamber 24*a* and the lock groove 27*b*, and as shown in FIG. 3, the lock member 27*a* is retracted from the lock groove 27*b* to establish the unlocked state. In the unlocked state, the relative rotational phase is changeable as desired and is changed to states shown in FIGS. 4 and 5 as the oil is supplied to the advanced angle chamber 24*a*. Thereafter, the relative rotational phase is changed between the most advanced angle phase and the most retarded angle phase in accordance with an engine load and a rotation speed of the engine.

The relative rotational phase immediately before stopping the engine is assumed to be the most retarded angle phase because the idling operation is performed. In those circumstances, at least the lock member 27*a* positioned at the retarded angle side is protruded into the lock groove 27*b*. When the ignition key is operated to be OFF, the inner rotor 22 flutters by a fluctuation of the cam torque, the lock member 27*a* positioned at the advanced angle side protrudes into the lock groove 27*b* to establish the locked state. Accordingly, the following engine starting operation is favorably operated.

Constructions of the passage dimension regulating mechanism 3 includes a spool housing portion 35 positioned orthogonally to the lubrication fluid passage 13, and a retainer housing portion 36 formed continuously from the spool housing portion 35 at a side opposite to the lubrication fluid passage 13 relative to the spool housing portion 35. The oil from the discharging fluid passage 11*a* is supplied to the spool housing portion 35 via the lubrication fluid passage 13. An operational fluid passage 14 is connected to an end surface of the retainer housing portion 36 at an opposite side relative to the spool housing portion 35 in an orthogonal direction relative to the lubrication fluid passage 13. The oil flowing in the retarded angle fluid passage 12B after passing through the OCV 4 is supplied to the retainer housing portion 36 via the operational fluid passage 14.

As shown in FIG. 2, a spool (i.e., serving as a movable member) 31 which is slidable along a configuration of the spool housing portion 35 and is configured to move forward and retract relative to the lubrication fluid passage 13 is disposed in the spool housing portion 35. A retainer 32 which is slidable along a configuration of the retainer housing portion 36 is disposed in the retainer housing portion 36.

Figure 6A:
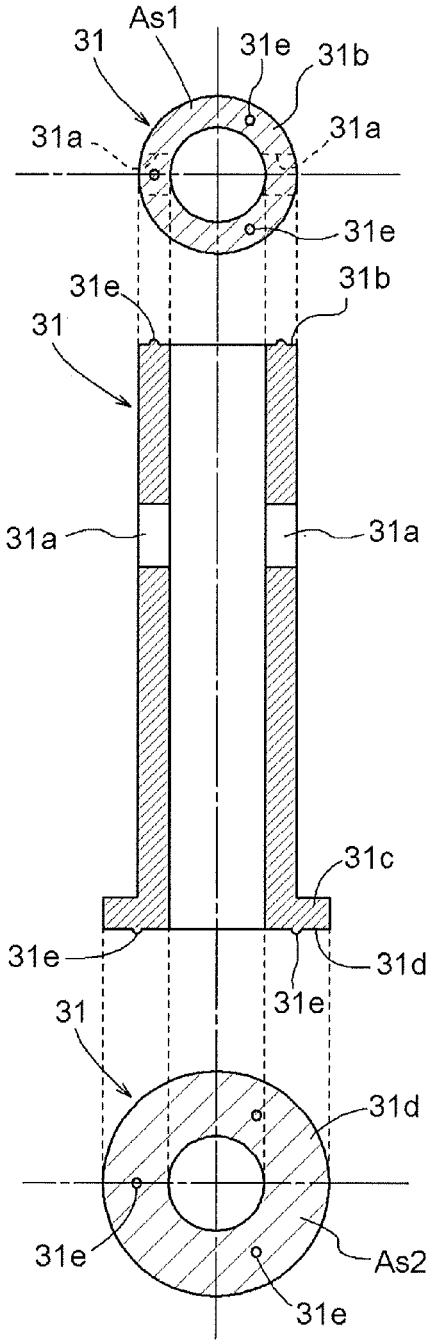
FIG. 6A shows plan views and a longitudinal cross-sectional view of a spool.
Figure 6B:
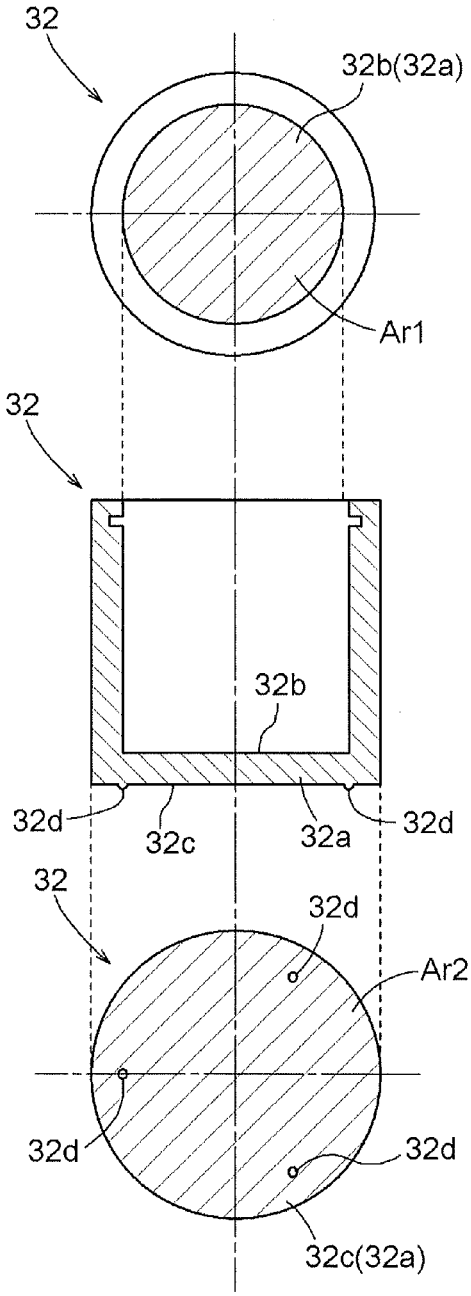
FIG. 6B shows plan views and a longitudinal cross-sectional view of a retainer.

As shown in FIGS. 2 and 6, the spool 31 is a cylindrical member having a flange portion 31*c* which extends outwardly in a radial direction at an outer periphery of an end portion. Two opening portions (i.e., serving as an opening) 31*a* are formed on a cylindrical wall portion of the spool 31. The opening portions 31*a*, 31*a* are formed penetrating through the spool 31 in a direction orthogonal to a sliding direction of the spool 31. An outer diameter of the wall portion of the spool 31 is approximately the same size with an inner diameter of the spool housing portion 35. The retainer 32 is a cup shaped member which is formed by forming a wall portion from an outer periphery of a bottom portion 32*a* in a perpendicular direction. An outer diameter of the retainer 32 is greater than the outer diameter of the spool 31. An outer diameter of the retainer 32 is approximately the same size with an inner diameter of the retainer housing portion 36. An inner diameter of the wall portion of the retainer 32 is approximately the same size with an outer diameter of the flange portion 31*c*. The retainer 32 is fitted to an outer periphery of the spool 31 to retain the flange portion 31*c* of the spool 31 to be fitted therein. A spring 34 serving as a biasing member is provided between the wall portion of the spool 31 and the wall portion of the retainer 32, and a C-ring 33 is fitted in a groove formed on an inner peripheral surface of the wall portion of the retainer 32 to compress the spring 34 by a bottom surface of the C-ring 33 and a top surface of the flange portion 31*c*. Accordingly, the spool 31 and the retainer 32 relatively move while sliding each other. Further, the spool 31 and the retainer 32 are biased in a direction so that a bottom surface 31*d* of the spool 31 is pressed to an inner bottom surface 32*d* of the retainer 32 by means of the spring 34. In other words, the spool 31 and the retainer 32 are biased so as not to be separated from each other.

The spool 31 and the retainer 32 are disposed within the spool housing portion 35 and the retainer housing portion 36 in a state where the spool 31 and the retainer 32 are assembled each other so that the opening portions 31*a* constantly allow the communication between an upstream side and a downstream side of the lubrication fluid passage 13. Because the oil in the lubrication fluid passage 13 enters the spool 31 via the opening portion 31*a*, the hydraulic pressure of the lubrication fluid passage 13 is applied to the spool 31 and the retainer 32. Because the oil in the operational fluid passage 14 is allowed to flow into the retainer housing portion 36, the hydraulic pressure in the operational fluid passage 14 is also selectively applied to the retainer 32.

The spool 31 moves forward or retracts relative to the lubrication fluid passage 13 by the application of the hydraulic pressure in the lubrication fluid passage 13. The opening portions 31*a*, a top end portion 31*b*, and the bottom surface 31*d* of the spool 31 receive the hydraulic pressure in a direction to move forward or retract the spool 31. Because the opening portions 31*a* receive the pressure in both of a forwarding direction and a retracting direction of the spool 31, the application of the hydraulic pressure is canceled at the opening portions 31*a*. Further, because a flange portion dimension As2 serving as a second pressure receiving dimension is greater than an end portion dimension As1 serving as a first pressure receiving dimension, as shown in FIG. 6, the spool 31 receives a force in the forwarding direction, which is calculated by "(hydraulic pressure in the lubrication fluid passage 13)*(flange portion dimension As2−end portion dimension As1)" (i.e., hereinafter refereed to as a force Fs) and a biasing force of the spring 34 in the retracting direction (i.e., hereinafter referred to as a biasing force Fp). That is, a portion subtracting a portion corresponding to the end portion dimension As1 from the bottom surface 31*d* serves as a pressure receiving portion. When the force Fs exceeds the biasing force Fp upon an increase of the hydraulic pressure in the lubrication fluid passage 13, the spool 31 starts moving in the forwarding direction. When the engine is stopped and the pump 1 does not operate, the retainer 32 does not operate, and as shown in FIG. 3, the spool 31 is retracted from the lubrication fluid passage 13 by its own weight together with the retainer 32.

Figure 4:
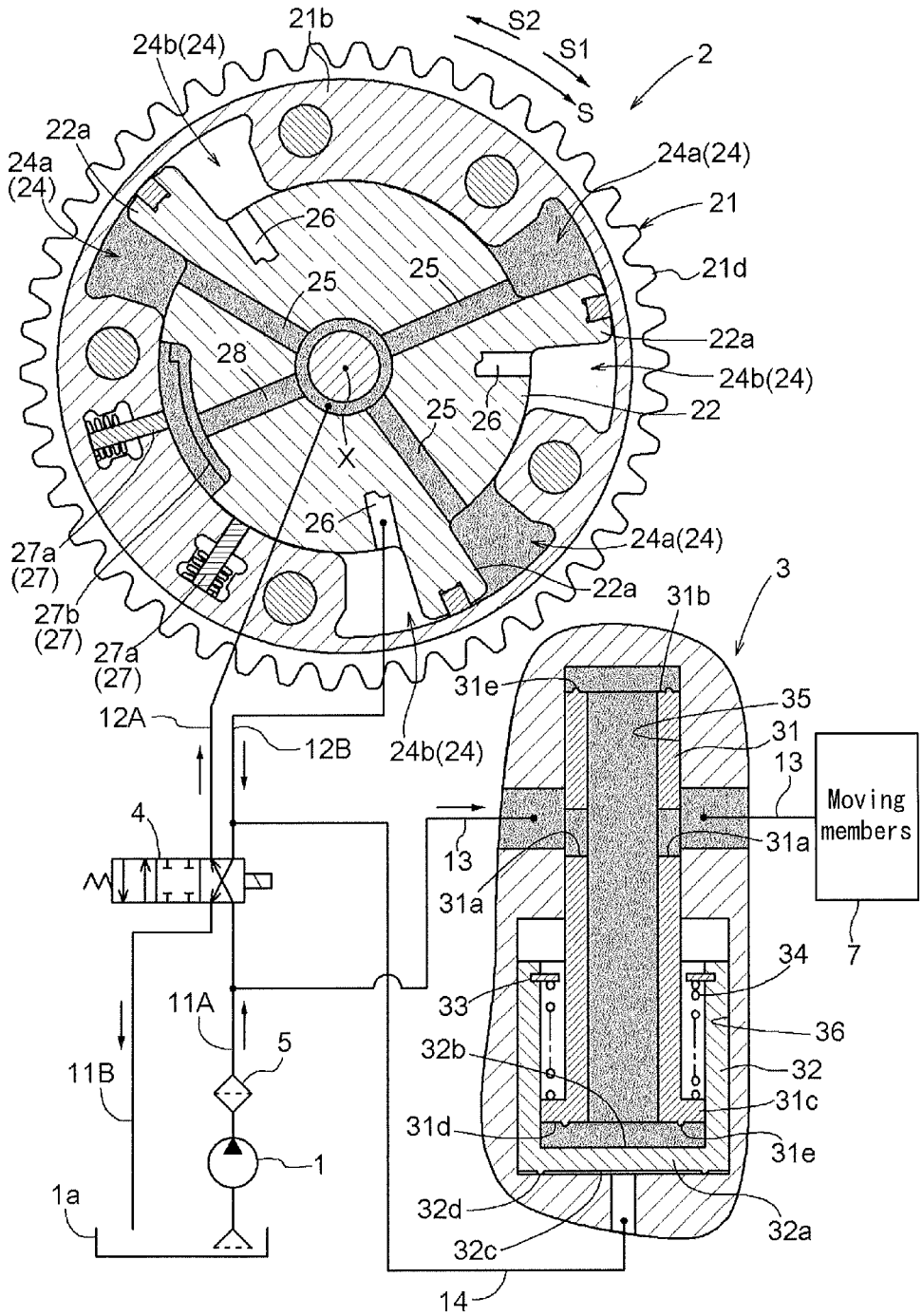
FIG. 4 is a cross-sectional view of the oil pressure control apparatus when the oil temperature is between the first predetermined temperature and the second predetermined temperature and the rotation speed of the engine is increasing.
Figure 5:
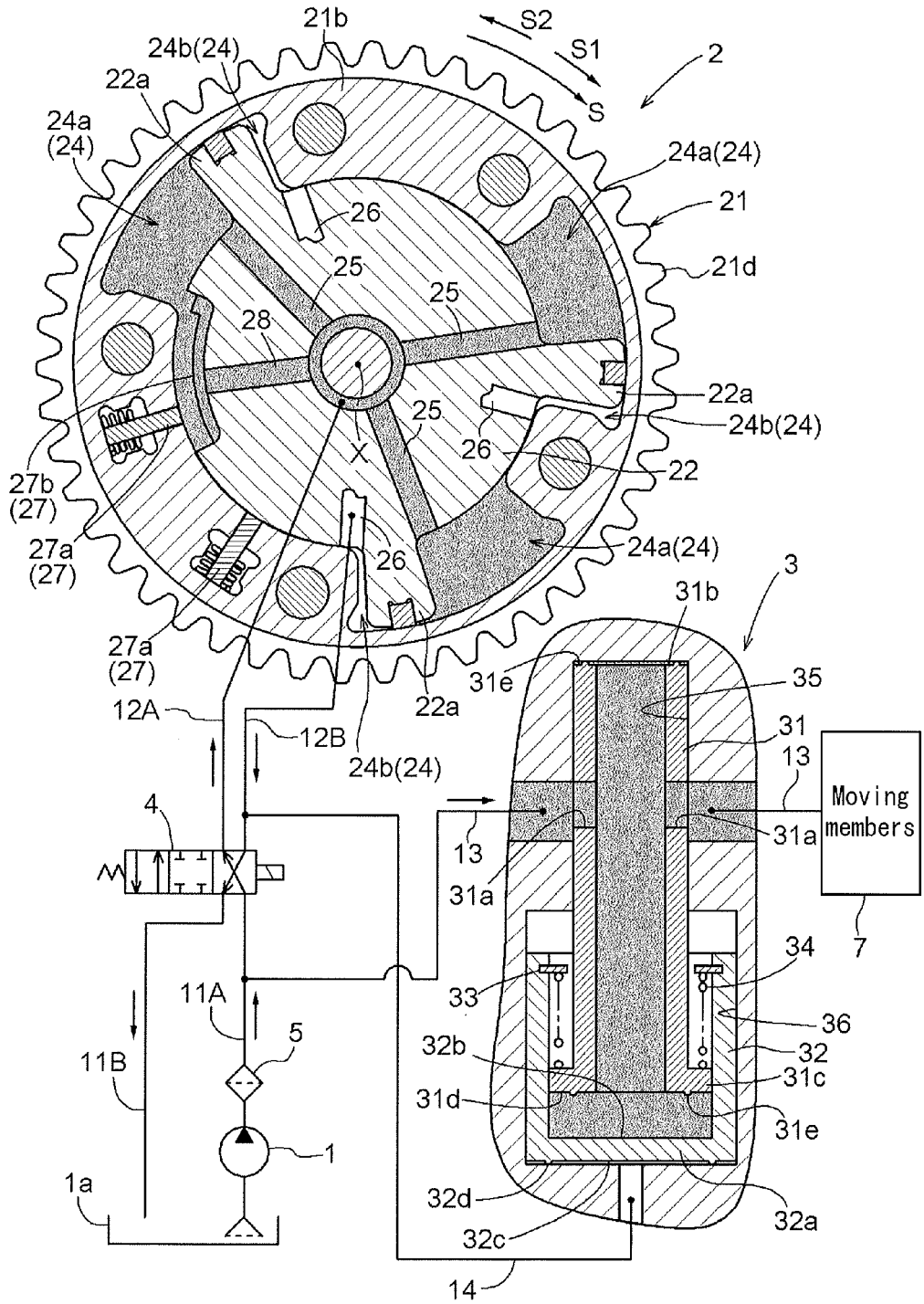
FIG. 5 is a cross-sectional view of the oil pressure control apparatus when the oil temperature is between the first predetermined temperature and the second predetermined temperature and a rotation speed of an engine is relatively high.

Thus, the spool 31 is slidable by the application of the hydraulic pressure in the lubrication fluid passage 13 from a state where the bottom surface 31*d* contacts an inner bottom surface 32*b* as shown in FIG. 3 to a state where the end portion 31*b* contacts an end surface of the spool housing portion 35 positioned opposite from the retainer housing portion 36 as shown in FIG. 5. A dimension of the opening portion 31*a* is smaller than a dimension of a cross-section of the lubrication fluid passage 13. Thus, when the entire opening portion 31*a* faces the lubrication fluid passage 13, the passage dimension of the lubrication fluid passage 13 is assumed to be the maximum (i.e., the lubrication fluid passage 13 is fully open). When the spool 31 is most retracted from the lubrication fluid passage 13 as shown in FIG. 3, the dimension of the lubrication fluid passage 13 is assumed to be the smallest. When the spool 31 thrusts forward to further protrude relative to the lubrication fluid passage 13 to be a state shown in FIG. 4 from the state shown in FIG. 3, the fluid passage dimension of the lubrication fluid passage 13 increases. When the spool 31 further moves forward to further protrude relative to the lubrication fluid passage 13 so that a bottom end position of the opening portion 31*a* corresponds to a bottom end position of the lubrication fluid passage 13, the passage dimension of the lubrication fluid passage 13 is assumed to be the maximum (i.e., the lubrication fluid passage 13 is fully open). Even if the spool 31 further moves forward to further protrude relative to the lubrication fluid passage 13, the opening portion 31*a* does not reduce the fluid passage dimension of the lubrication fluid passage 13 to maintain the fully open state of the lubrication fluid passage 13. In the state where the spool 31 is protruded to a maximum relative to the lubrication fluid passage 13 as shown in FIG. 5, a top end position of the opening portion 31*a* approximately corresponds to a top end position of the lubrication fluid passage 13.

The retainer 32 slides inside the retainer housing portion 36 by means of the hydraulic pressure of the operational fluid passage 14 and the hydraulic pressure of the lubrication fluid passage 13. As shown in FIG. 6, the retainer 32 receives a force directed in the retracting direction and calculated by multiplying the hydraulic pressure of the lubrication fluid passage 13 by an inner dimension Ar1 of a bottom portion of the retainer 32 serving as a third pressure receiving dimension (i.e., "(the hydraulic pressure of the lubrication fluid passage 13)*(the inner dimension Ar1 of the bottom portion of the retainer 32)") (i.e., hereinafter referred to as a force Fr1), a force directed in the forwarding direction of the spool 31 and calculated by multiplying the hydraulic pressure of the operational fluid passage 14 and an outer dimension Ar2 of the bottom portion serving as a fourth pressure receiving dimension (i.e., "the hydraulic pressure of the operational fluid passage 14)*(the outer dimension Ar2 of the bottom portion) (i.e., hereinafter referred to as a force Fr2), and the biasing force Fp directed in the forwarding direction of the spool 31. That is, an outer bottom surface 32*c* of the bottom portion 32*a* serves as a surface of a bottom portion of a retainer at an opposite side from the spool.

In those circumstances, a level of the hydraulic pressure of the operational fluid passage 14 is assumed to be constantly lower than the hydraulic pressure of the lubrication fluid passage 13 due to a friction loss by a resistance in a passage by a degree determined by the friction loss caused by the oil flowing through the OCV 4 before flowing in the operational fluid passage 14. However, according to the construction of the embodiment, the inner dimension Ar1 of the bottom portion and the outer dimension Ar2 of the bottom portion are defined so that an addition of the force Fr2 and the biasing force Fp is assumed to be greater than the force Fr1 when a discharging pressure of the pump 1 is low and a level of the hydraulic pressure is overall lower. For example, according to the embodiment, the inner dimension Ar1 of the bottom portion and the outer dimension Ar2 of the bottom portion are defined based on the discharging pressure of the pump 1 during a warming-up operation of the engine. Accordingly, when the rotation speed of the engine at a timing is lower than the rotation speed of the engine during the warming-up operation, as shown in FIG. 2, the retainer 32 moves towards the lubrication fluid passage 13. In those circumstances, the bottom portion 32*a* of the retainer 32 comes to engage with the flange portion 31*c* of the spool 31 and the spool 31 moves forward to further project relative to the lubrication fluid passage 13. When the rotation speed at a timing is assumed to be higher than the rotation speed of the engine during the warming-up operation, the force Fr1 is assumed to be greater than the addition of the force Fr2 and the biasing force Fp, and the retainer 32 moves towards the operational fluid passage 14 as shown in FIGS. 3 and 5. When the oil is not supplied to the operational fluid passage 14, that is, when the OCV 4 is controlled under the advanced angle control, as shown in FIGS. 3 and 5, the retainer 32 moves towards the operational fluid passage 14.

Thus, by the application of the hydraulic pressure of the lubrication fluid passage 13 or by the application of the hydraulic pressure of the lubrication fluid passage 13 and the hydraulic pressure of the operational fluid passage 14, the retainer 32 is slidable from a state where the outer bottom surface 32*c* contacts an end surface of the retainer housing portion 36 at an opposite side from the spool housing portion 35 as shown in FIG. 5 to a state where an end portion contacts a stepped surface between the spool housing portion 35 and the retainer housing portion 36 as shown in FIG. 2.

As illustrated in FIG. 6, plural projections serving as spacer portions 31*e* are formed on the top end portion 31*b* and the bottom surface 31*d* of the spool 31. Further, plural projections serving as spacer portions 32*d* are formed on the outer bottom surface 32*c* of the retainer 32. Thus, as shown in FIGS. 2 and 3, a minimum clearance is formed between the spool housing portion 35 and the top end portion 31*b*, between the bottom portion 32*a* and the flange portion 31*c*, and between the retainer housing portion 36 and the bottom portion 32*a*. Accordingly, the oil flows into each minimum clearance smoothly so that the hydraulic pressure is securely applied to each portion.

An operation of the oil pressure control apparatus will be explained with reference to the illustrations of the drawing figures. "II," "III," "IV," and "V" in FIGS. 7A to 7C indicate that the operational state of the oil pressure control apparatus corresponds to the states shown in FIGS. 2, 3, 4, and 5, respectively.

Figure 7A:
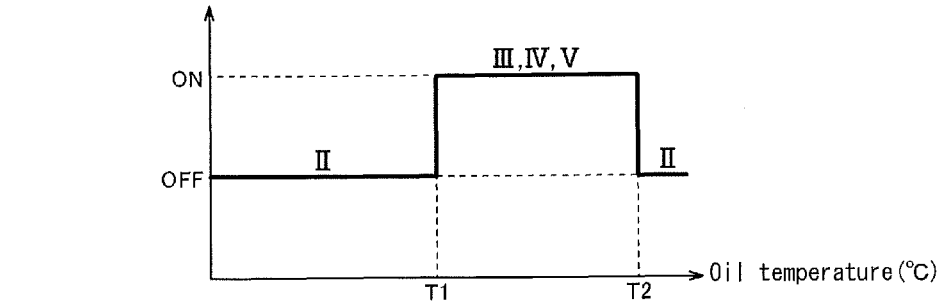
FIG. 7A shows a relationship between an oil temperature and an ON/OFF state of an oil control valve (OCV)

Immediately after the engine start, it is not necessary to operate the valve timing control apparatus 2, thus not requiring the hydraulic pressure. On the other hand, the moving members 7 require the oil serving as a lubrication fluid to start operating. When the oil temperature is lower than a predetermined first set temperature T1, as shown in FIG. 7A, the OCV 4 is not energized (OFF). That is, the OCV 4 is maintained at a state for the retarded angle control, the retarded angle fluid passage 12B is connected to the output fluid passage 11A, and the advanced angle fluid passage 12A is connected to the return fluid passage 11B. Even if the cranking starts in the foregoing state and the warming-up of the engine operation starts thereafter, the rotation speed of the engine and the oil temperature are low immediately after the engine starts. Accordingly, because the hydraulic pressure of the discharging fluid passage 11A is low and the hydraulic pressure of the lubrication fluid passage 13 is low, the spool 31 is not actuated by the hydraulic pressure of the lubrication fluid passage 13. However, on the other hand, irrespective of the locked state of the valve timing control apparatus 2, the oil is supplied to the retarded angle chamber 24*b* and the hydraulic pressure of the retarded angle fluid passage 12B is increased. The oil with the increased hydraulic pressure is supplied to the retainer housing portion 36 via the operational fluid passage 14, and as shown in FIG. 2, the retainer 32 pushes the spool 31 to further protrude relative to the lubrication fluid passage 13. Consequently, the lubrication fluid passage 13 is fully open (i.e., the passage dimension of the lubrication fluid passage 13 is assumed to be the maximum), and the oil is supplied to the moving members 7 preferentially.

Figure 7B:
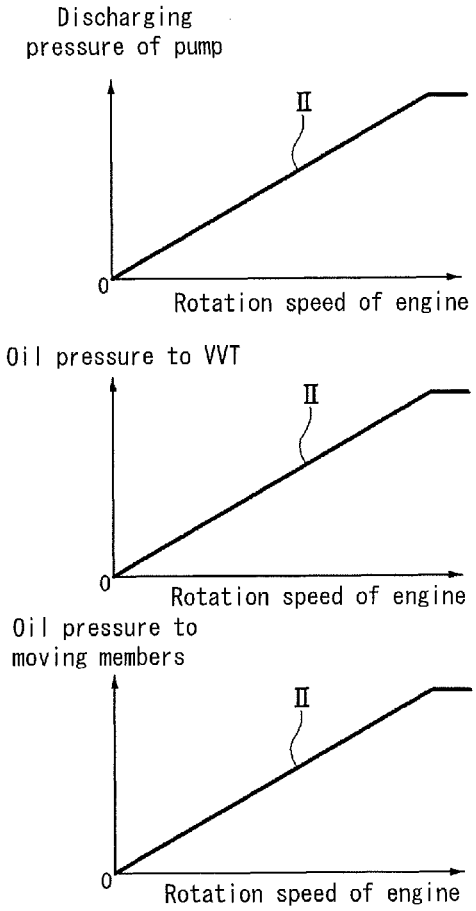
FIG. 7B shows a relationship between a rotation speed of the engine and an oil pressure of each portion when the oil temperature is lower than the first predetermined temperature or higher than the second predetermined temperature.

Relationships of the oil discharging pressure of the pump 1, the hydraulic pressure supplied to the valve timing control apparatus 2, and the hydraulic pressure supplied to the moving members 7 are shown in FIG. 7B. As shown in FIG. 7B, the hydraulic pressure supplied to the valve timing control apparatus 2 and the hydraulic pressure supplied to the moving members 7 follow an increase of the oil discharging pressure of the pump 1.

When an operator steps on the acceleration pedal after the completion of the warming-up operation due to the increase of the oil temperature to be higher than the first set temperature T1, the OCV 4 is energized (ON), and the control state is transited to the advanced angle control state. Thus, in order to stably start the operation of the valve timing control apparatus 2, the hydraulic pressure is required. However, because the OCV 4 is in the advanced angle control state, in this case, the advanced angle fluid passage 12A is connected to the discharging fluid passage 11A and the retarded angle fluid passage 12B is connected to the return fluid passage 11B. Accordingly, the hydraulic pressure of the operation fluid passage 14 connected to the retainer 32 declines suddenly. In consequence, only the hydraulic pressure of the lubrication fluid passage 13 is applied to the bottom portion 32*a*, and the retainer 32 moves towards the operational fluid passage 14 as shown in FIG. 3. In those circumstances, the spool 31 moves together with the retainer 32 via the spring 34 to retract from the lubrication fluid passage 13 to reduce the fluid passage dimension of the lubrication fluid passage 13. As foregoing, in a case where the engine rotation speed is lower and the oil discharging pressure of the pump 1 is still lower even if the oil temperature is increased, the oil is preferentially supplied to the valve timing control apparatus 2. When the oil temperature is increased, a viscosity of the oil is decreased to allow the oil to leak from clearances of parts readily thus to decline the hydraulic pressure. Further, the hydraulic pressure declines when the rotation speed of the engine is decreased. Thus, even though the hydraulic pressure supplied to the valve timing control apparatus 2 is increased due to an increase of the volume of the oil supplied to the valve timing control apparatus 2 by reducing the passage dimension of the lubrication fluid passage 13 by means of the spool 31, the increase of the hydraulic pressure to be supplied to the valve timing control apparatus 2 is assumed to be an appropriate level because of the lower engine rotation speed and the increase of the oil temperature. Accordingly, an appropriate level of the hydraulic pressure is applied to the valve timing control apparatus 2.

Thereafter, as the engine rotation speed increases, the oil discharging pressure of the pump 1 is increased to increase the hydraulic pressure of the lubrication fluid passage 13, and the spool 31 gradually opens the lubrication fluid passage 13 from the state shown in FIG. 3 to the state shown in FIG. 4 and to the state shown in FIG. 5 so that the lubrication fluid passage 13 is fully open eventually. Accordingly, the oil is adequately supplied to the moving members 7 which require large volume of the lubrication fluid in response to the increase of the engine rotation speed. Although a higher level of the hydraulic pressure is necessary to be supplied to the valve timing control apparatus 2 when the rotation speed of the engine is increased, the adequate volume of the oil is supplied to the valve timing control apparatus 2 because the oil discharging pressure of the pump 1 is increased as a whole. Thereafter, even after the retarded angle control is performed and the oil is supplied to the retainer housing portion 36 which houses the retainer 32, the hydraulic pressure is still increased, and the force Fr1 is assumed to be greater than the addition of the force Fr2 and the biasing force Fp. Accordingly, the position of the retainer 32 is maintained to the side of the operational fluid passage 14. In other words, when the oil temperature is higher than the first set temperature T1, the retainer 32 does not function, and the spool 31 is operated to regulate the fluid passage dimension of the lubrication fluid passage 13 in response to an increase or decrease of the hydraulic pressure only from the lubrication fluid passage 13.

Figure 7C:
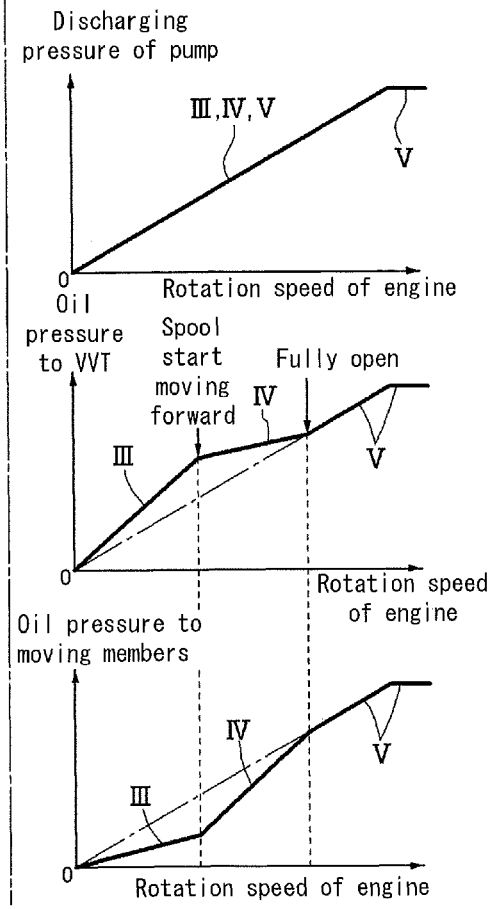
FIG. 7C shows a relationship between the rotation speed of the engine and the oil pressure of each of the portions when the oil temperature is between the first predetermined temperature and the second predetermined temperature.

Relationships of the oil discharging pressure of the pump 1, the hydraulic pressure supplied to the valve timing control apparatus 2, and the hydraulic pressure supplied to the moving members 7 at the timings shown in FIGS. 3 to 5 are shown in FIG. 7C. When the oil pressure control apparatus is operated in the state III shown in FIG. 3, because the dimension of the lubrication fluid passage 13 is reduced, an increasing rate of the hydraulic pressure of the moving members 7 is decreased and an increasing rate of the hydraulic pressure of the valve timing control apparatus 2 is increased. When the oil pressure control apparatus is operated in the state IV shown in FIG. 4 where the spool 31 starts moving forward to further protrude relative to the lubrication fluid passage 13, because the fluid passage dimension of the lubrication fluid passage 13 starts increasing, the increasing rate of the hydraulic pressure of the moving members 7 is increased and the increasing rate of the hydraulic pressure of the valve timing control apparatus 2 is decreased. When the oil pressure control apparatus is operated in the state V shown in FIG. 5 where the spool 31 is protruded to the maximum relative to the lubrication fluid passage 13, because the lubrication fluid passage 13 is fully open, both of the hydraulic pressure of the moving members 7 and the hydraulic pressure of the valve timing control apparatus 2 follow an increase of the oil discharging pressure of the pump 1.

The valve timing control apparatus 2 includes slight clearances between parts. Particularly, when a viscosity of the oil is low, the oil may leak via the slight clearances. When the oil leaks, the hydraulic pressure cannot be efficiently applied to the valve timing control apparatus 2, and a displacement of the relative rotational phase by the valve timing control apparatus 2 is not swiftly operated. In those circumstances, on one hand, a fuel efficiency of the engine by the valve timing control apparatus 2 is expected, however, on the other hand, the pump 1 has to be aggressively operated in order to operate the valve timing control apparatus 2, which deteriorates the fuel efficiency of the engine.

Thus, when the oil temperature further increases to be higher than a second set temperature T2 and the oil viscosity is assumed to be lower, as shown in FIG. 7A, the OCV 4 is not energized (OFF). That is, the OCV 4 is maintained at the state of a retarded angle control where the retarded angle fluid passage 12B is connected to the discharging fluid passage 11A and the advanced angle fluid passage 12A is connected to the return fluid passage 11B. In consequence, the relative rotational phase is assumed to be the most retarded angle phase and the locked state is established by the lock mechanism 27. When the oil temperature is assumed to be higher than the second set temperature T2, an operation of the valve timing control apparatus 2 is stopped to restrain a necessary power for the pump 1.

The second set temperature T2 is defined to be higher than the first set temperature T1. For example, the first set temperature T1 may be defined at 55 to 65 degrees Celsius and the second set temperature T2 may be defined at 100 to 110 degrees Celsius.

Modified examples will be explained as follows. First, according to the foregoing embodiment, the valve timing control apparatus 2 controls an opening/closing timing of an intake valve. However, the construction of the oil pressure control apparatus is not limited to the foregoing embodiment. For example, the valve timing control apparatus may control an opening/closing timing of an exhaust valve.

Second, according to the foregoing embodiment, the lock mechanism 27 restricts the relative rotational phase at the most retarded angle phase. However, the construction of the oil pressure control apparatus is not limited to the foregoing embodiment. For example, the lock mechanism may be configured to restrict the relative rotational phase at an intermediate phase between the most retarded angle phase and the most advanced angle phase, or at the most advanced angle phase.

Third, according to the foregoing embodiment, an example where the lock mechanism 27 restricts the relative rotational phase is disclosed. However, for example, a lock mechanism having a lock member which is configured to move protruding or retracting in a direction of the axis X, or a lock mechanism having one lock member for each lock groove (i.e., one-on-one relationship) may be applied. Further, a construction without the lock mechanism may be adopted. For example, the relative rotational phase may be restricted by pressing the vane to an end surface of the hydraulic pressure chamber by the hydraulic pressure of the oil.

Fourth, according to the foregoing embodiment, the oil pressure control apparatus includes the torsion spring 23 biasing the inner rotor 22 towards the advancing angle side. However, the construction of the oil pressure control apparatus is not limited to the foregoing embodiment. For example, a torsion spring biasing the inner rotor 22 towards the retarded angle side may be adopted.

Fifth, according to the foregoing embodiment, the retarded angle fluid passage 12B serves as the second fluid passage. However, the construction of the oil pressure control apparatus is not limited to the foregoing embodiment. For example, when a valve timing control apparatus for an exhaust valve is applied, when a lock mechanism is configured to restrict the relative rotational phase at a phase other than the most retarded angle phase, when a relationship between a displacement force based on a cam torque fluctuation and a biasing force of a torsion spring is changed, or when a method for unlocking the lock mechanism is changed, the operational fluid passage for the retainer may be connected to the advanced angle fluid passage. Further, the operational fluid passage for the retainer may be connected to both of the advanced angle fluid passage and the retarded angle fluid passage.

Sixth, according to the foregoing embodiment, the retarded angle control is assumed to be available when the OCV 4 is energized, and the advanced angle control is assumed to be available when the OCV 4 is stopped to be energized. However, the construction of the oil pressure control apparatus is not limited to the foregoing embodiment. The OCV may be configured to perform the advanced angle control by being energized and to perform the retarded angle control by not being energized.

Seventh, according to the foregoing embodiment, the opening portion 31*a* is defined to be smaller than the cross-section of the lubrication fluid passage 13. However, the construction of the oil pressure control apparatus is not limited to the foregoing embodiment. As long as the fluid passage dimension of the lubrication fluid passage 13 can be regulated by moving the spool 31 in the forwarding direction and the retracting direction, the opening portion 31*a* may be defined to be greater than the fluid passage cross-section of the lubrication fluid passage 13. Further, a cross-sectional configuration of each of the passages and a configuration of the opening portion 31*a* are not limited to a polygonal cross-section or a circular cross-section, or the like, as long as the passages achieve functions thereof, respectively.

The oil pressure control apparatus disclosed here is applicable to an engine which includes a valve timing control apparatus.

According to the embodiment, the lubrication fluid passage 13 for supplying the oil serving as the lubrication fluid to the predetermined portion other than the valve timing control apparatus 2 which controls the displacement of the relative rotational phase, that is, to the moving members 7 is connected to the discharging fluid passage 11A which is positioned closer to the pump 1 than the oil control valve 4, and the spool 31 which is configured to regulate the fluid passage dimension of the lubrication fluid passage 13 by the hydraulic pressure of the lubrication fluid passage 13 is provided on the lubrication fluid passage 13. Further, the spool 31 increases the fluid passage dimension of the lubrication fluid passage 13 in response to an increase of the hydraulic pressure of the lubrication fluid passage 13. Accordingly, when a discharging pressure of the pump 1 is increased in response to an increase of the rotation speed of the engine, an opening degree of the lubrication fluid passage 13 is increased to supply the appropriate amount of the oil to the moving members 7.

The operation fluid passage 14 connects the retarded angle fluid passage 12B which is positioned closer to the valve timing control apparatus 2 than the oil control valve 4 and the fluid passage dimension regulating mechanism 3 which is configured to bias the spool 31 towards a side for increasing the fluid passage dimension of the lubrication fluid passage 13 by the application of the oil pressure other than the oil pressure of the lubrication fluid passage 13. Because the oil control valve 4 is configured to control the supply of the oil outputted from the pump 1 to the valve timing control apparatus 2 and the discharge of the oil from the valve timing control apparatus 2, an oil supply state of the operation fluid passage 14 is assumed to be determined in response to a control of the oil control valve 4, that is, determined in response to an operation of the valve timing control apparatus 2.

In other words, in addition to regulating the fluid passage dimension of the lubrication fluid passage 13 by the hydraulic pressure of the oil which flows in the lubrication fluid passage 13, the fluid passage dimension of the lubrication fluid passage 13 is regulated by changing the hydraulic pressure in the retarded angle fluid passage 12B by operating the oil control valve 4.

For example, when supplying the oil to the moving members 7, normally, it is necessary to increase an amount of the oil to supply in response to an increase of the rotation speed of the engine. According to the constructions of the embodiment, the lubrication fluid passage 13 which is connected to the moving members 7 is diverged immediately after the pump 1 to increase the fluid passage dimension in response to the increase of the hydraulic pressure of the lubrication fluid passage 13. Because the rotation speed the pump 1 and the rotation speed of the engine are synchronized, by gradually increasing the rotation speed of the engine, the amount of the oil supplied to the moving members 7 is increased, accordingly.

According to the oil pressure control apparatus, at least during a normal operational state, the oil amount supplied to the moving members 7 is appropriately regulated. Further, by operating the oil control valve 4, the fluid passage dimension of the lubrication fluid passage 13 is positively reduced to increase the hydraulic pressure of the retarded angle fluid passage 12B. For example, when the oil is needed to be supplied to the moving members 7 such as immediately after the start of the engine, portions to which the oil is to be supplied are regulated by operating the oil control valve 4.

Accordingly, the oil pressure control apparatus which controls the hydraulic pressure in accordance with a driving state of the engine without providing an oil control valve for controlling an operation of the spool 31 is attained.

According to the embodiment, the retarded angle fluid passage 12B is connected to a fluid passage provided between the valve timing control apparatus 2 and the oil control valve 4.

According to the embodiment, the retarded angle fluid passage 12B is provided for selectively changing the relative rotational phase of the rotor 22 relative to the housing 21 to an advancing angle side and a retarded angle side.

According to the embodiment, the spool 31 is movable to a position at which the opening portion 31*a* formed on the spool 31 fully opens the lubrication fluid passage 13 when the oil control valve 4 is set to a state for maximally supplying the oil to the retarded angle fluid passage 12B.

According to the embodiment, when the oil control valve 4 is set to be a state for maximally supplying the oil to the retarded angle fluid passage 12B, the oil which is supposed to be supplied to the valve timing control apparatus 2 is supplied to the operation fluid passage 14 to be applied to the spool 31 to fully open the lubrication fluid passage 13 irrespective of the level of the hydraulic pressure of the lubrication fluid passage 13 applied to the spool 31. Accordingly, adequate amount of the oil can be supplied to the moving members 7 with a simple control.

According to the embodiment, the oil control valve 4 is maintained at a state for maximally supplying the oil to the retarded angle fluid passage 12B when the oil temperature is lower than the predetermined first set temperature T1.

For example, the rotation speed of the engine is lower and the oil temperature is low immediately after the engine is started. Further, a degree of the oil viscosity is assumed to be higher and the circulation performance of the oil is assumed to be lower when the oil temperature is lower. Because the temperature of an engine body is lower and an intake-air temperature is lower immediately after starting the engine, the valve timing control apparatus 2 is not necessarily to be operated. That is, although the valve timing control apparatus 2 does not require great amount of the hydraulic pressure, the moving members 7 needs the oil for the lubrication immediately after the engine is started. However, because the circulation performance of the oil is assumed to be lower immediately after the engine is started, the spool 31 may not move swiftly only by the hydraulic pressure of the lubrication fluid passage 13, thus not to be able to open the lubrication fluid passage 13.

However, according to the embodiment, by maintaining the oil control valve 4 to be a state for maximally supplying the oil to the retarded angle fluid passage 12B, the spool 31 fully opens the lubrication fluid passage 13 irrespective of the level of the hydraulic pressure of the lubrication fluid passage 13 which is applied to the spool 31, and thus the oil is preferentially supplied to the moving members 7.

On the other hand, when the oil temperature is increased to some degree by a warming-up operation of the engine, the oil control valve 4 starts operating in order to operate the valve timing control apparatus 2. When the oil control valve 4 operates in order to operate the valve timing control apparatus 2, the hydraulic pressure of the operation fluid passage 14 applied to the fluid passage dimension regulating mechanism 3 is declined to reduce the dimension of the lubrication fluid passage 13 by the operation of the spool 31. The operation of the spool 31 thereafter is directly controlled by an increase and decrease of the hydraulic pressure of the lubrication fluid passage 13, that is, by an increase and decrease of the discharging pressure of the pump 1. Accordingly, when the rotation speed of the engine is lower and the oil pressure is lower, by reducing the dimension of the lubrication fluid passage 13 by the spool 31 to supply the oil preferentially to the valve timing control apparatus 2, the hydraulic pressure applied to the valve timing control apparatus 2 is increased to stably start controlling the valve timing control apparatus 2.

When the rotation speed of the engine is increased, the spool 31 gradually opens the lubrication fluid passage 13 to eventually fully open the lubrication fluid passage 13. Thus, necessary amount of the oil is supplied to the moving members 7 in accordance with an operation state of the vehicle. Although it is necessary to supplied the hydraulic pressure to the valve timing control apparatus 2 as well in those circumstances, the adequate amount of the oil is supplied to the retarded angle fluid passage 12B because the output pressure of the pump 1 is increased as a whole.

According to the oil pressure control apparatus of the embodiment, the oil pressure is controlled to be a level appropriate for the operational state of the engine on the basis of the operation of the valve timing control apparatus 2 for controlling an opening/closing timing of valves in response to the operational state of the engine.

According to the embodiment, the oil control valve 4 is maintained at a state for maximally supplying the oil to the retarded angle fluid passage 12B when the oil temperature is higher than the predetermined second set temperature T2.

For example, as explained above, the oil temperature is lower and the oil viscosity is higher immediately after the engine starts. Thus, the circulation performance of the oil is assumed to be lower. On the other hand, when the warming-up operation of the engine is completed, the oil temperature is assumed to be higher and the oil viscosity is assumed to be lower. Thus, in those circumstances, the circulation performance of the oil is assumed to be higher.

Notwithstanding, in a case where the control apparatus to which the oil is supplied corresponds to an apparatus from which the oil leaks via small clearances between parts thereof like a valve timing control apparatus, an amount of the oil leaked from the smaller clearances between the parts thereof is increased when the oil viscosity is assumed to be lower and the oil pressure may not be efficiently applied to the control apparatus (e.g., valve timing control apparatus). When the control apparatus (e.g., valve timing control apparatus) is operated in those circumstances, it is necessary to positively operate the pump 1 for actuating the control apparatus (e.g., valve timing control apparatus) while expecting that the fuel consumption efficiency of the engine by the control apparatus (e.g., valve timing control apparatus) is enhanced. However, when the pump 1 is actuated by the rotation of the engine, because the output pressure of the pump 1 is determined based on the rotation speed of the engine, the output pressure of the pump 1 has to be increased by increasing the pump 1 in size in order to positively supply the oil pressure to the control apparatus (e.g., valve timing control apparatus). That is, in those circumstances, because a power for driving the pump 1 is necessary, the fuel consumption efficiency of the engine may rather decline.

According to the oil pressure control apparatus of the embodiment, when the oil temperature is higher than the second set temperature, the oil control valve 4 is maintained at the state for maximally supplying the oil to the retarded angle fluid passage 12B so as to fix the relative rotational phase at the desired phase. That is, when the oil temperature is higher than the second set temperature, the valve timing control apparatus 2 is not operated. Thus, in those circumstances, it is not necessary to positively operate the pump 1 for operating the valve timing control apparatus 2, which allows adopting a downsized pump as the pump 1.

According to the embodiment, the fluid passage dimension regulating mechanism 3 includes the cylindrical spool 31 having the wall portion on which the opening portion 31*a* is formed and being configured to receive the oil of the lubrication fluid passage 13 via the opening portion 31*a*, the retainer 32 having a cup shape for slidably retaining an end portion of the spool 31 therewithin at a side away from the lubrication fluid passage 13, and the spring 34 pressing the spool 31 to a bottom portion of the retainer 32. The spool 31 the portion subtracting a portion corresponding to the end portion dimension As1 from the bottom surface 31*d* (the first pressure receiving portion) to which the oil pressure from the third fluid passage is applied to move the spool 31 in a biasing direction of the spring 34 and the second pressure receiving dimension (As2, 31*d*) to which the oil pressure from the lubrication fluid passage 13 is applied to move the spool 31 in a direction opposite from the biasing direction of the spring 34. The second pressure receiving dimension (As2, 31*d*) is greater than the first pressure receiving dimension As1.

According to the embodiment, the fluid passage dimension regulating mechanism 3 includes the cylindrical spool 31 having a wall portion on which the opening portion 31*a* is formed and being configured to receive the oil of the lubrication fluid passage 13 via the opening portion 31*a*, the retainer 32 having a cup shape for slidably retaining an end portion of the spool 31 therewithin at a side away from the lubrication fluid passage 13, and the spring 34 pressing the spool 31 to a bottom portion of the retainer 32. The spool 31 includes the pressure receiving portion 31*d* to which the oil pressure of the lubrication fluid passage 13 is applied in a direction to be separated from the bottom portion of the retainer 32. The oil pressure of the operation fluid passage 14 is applied to the surface 32*c* of the bottom portion of the retainer 32 at an opposite side from the spool 31.

According to the oil pressure control apparatus of the embodiment, the oil of the lubrication fluid passage 13 flows into inside the spool 31 having a cylindrical shape via the opening portion 31*a* and the oil pressure supplied into the spool 31 is applied to the portion subtracting a portion corresponding to the end portion dimension As1 from the bottom surface 31*d* (the pressure receiving portion) of the spool 31. Accordingly, the spool 31 is biased in a forward direction to protrude from the retainer 32 (i.e., to protrude so that the bottom surface 31*d* of the spool 31 separates from the bottom portion 32*a* of the retainer 32). That is, as the oil pressure from the lubrication fluid passage 13 is increased, the spool 31 further protrudes relative to the lubrication fluid passage 13 so that the opening portion 31*a* opens the lubrication fluid passage 13.

Further, the hydraulic pressure of the operation fluid passage 14 is applied to the surface of the bottom portion 32*a* of the retainer 32 at the opposite side from the spool 31. The spool 31 moves via the retainer 32 in the same direction with the direction that the spool 31 moves by means of the oil pressure (hydraulic pressure) of the lubrication fluid passage 13. Because the retainer 32 retains the spool 31 therein, normally, a dimension of the bottom surface of the retainer 32 is defined to be greater than the portion subtracting a portion corresponding to the end portion dimension As1 from the bottom surface 31*d* (pressure receiving portion) of the spool 31. The retarded angle fluid passage 12B is positioned at a downstream of the discharging fluid passage 11A and the hydraulic pressure of the retarded angle fluid passage 12B is generally lower than the hydraulic pressure of the discharging fluid passage 11A. However, by applying the hydraulic pressure of the operation fluid passage 14 to the bottom surface of the retainer 32, according to the oil pressure control apparatus of the embodiment, the retainer 32 and spool 31 are operated in a state where the hydraulic pressure is lower to open the lubrication fluid passage 13.

Thus, the oil pressure control apparatus which enables to control the oil pressure appropriately in accordance with the operational state of the engine is achieved with the fluid passage dimension regulating mechanism 3 including the spool 31, the retainer 32, and the spring 34 having simple configurations.

According to the embodiment, the fluid passage dimension regulating mechanism 3 includes the cylindrical spool 31 having a wall portion on which the opening portion 31*a* is formed and being configured to receive the oil of the lubrication fluid passage 13 via the opening portion 31*a*, the retainer 32 having a cup shape for slidably retaining an end portion of the spool 31 therewithin at a side away from lubrication fluid passage 13, and the spring 34 pressing the spool 31 to a bottom portion of the retainer 32. The bottom portion of the retainer 32 includes the third pressure receiving dimension Ar1 to which the oil pressure of the lubrication fluid passage 13 is applied to move the retainer 32 in a biasing direction of the spring 34 and the fourth pressure receiving dimension Ar2 to which the oil pressure of the operation fluid passage 14 is applied to move the retainer 32 in a direction opposite from the biasing direction of the spring 34. An addition of a biasing force of the spring 34 and a force generated by the application of the oil pressure of the lubrication fluid passage 13 to the third pressure receiving dimension Ar1 is defined as the first pressure force, a force generated by the application of the oil pressure of the operation fluid passage 14 to the fourth pressure receiving dimension Ar2 is defined as the second pressure force. A magnitude relation of the first pressure force and the second pressure force is reversed in response to a level of the oil pressure of oil discharged from the pump 1.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An oil pressure control apparatus, comprising:

a pump driven by a rotation of a driving power source for discharging an oil;

a control apparatus including a driving side rotation member rotating synchronously to a crankshaft and a driven side rotation member arranged coaxially to the driving side rotation member and rotating synchronously to a camshaft, the control apparatus controlling an opening/closing timing of a valve by displacing a relative rotational phase of the driven side rotation member relative to the driving side rotation member by supplying or discharging the oil;

a control valve mechanism being in communication with the pump via a first fluid passage and being in communication with the control apparatus via a second fluid passage for controlling to supply and discharge the oil relative to the control apparatus;

a third fluid passage diverging from the first fluid passage to supply the oil to a predetermined portion other than the control apparatus; and a fluid passage dimension regulating mechanism including a movable member provided at the third fluid passage and including an opening for regulating a fluid passage dimension of the third fluid passage, the movable member being biased to a side for increasing the fluid passage dimension by an application of an hydraulic pressure of the third fluid passage; wherein the fluid passage dimension regulating mechanism is in communication with a fourth fluid passage diverging from the second fluid passage and biases the movable member to the side increasing the fluid passage dimension by applying the hydraulic pressure of the fourth fluid passage to the movable member separately from the hydraulic pressure of the third fluid passage.

2. The oil pressure control apparatus according to claim 1, wherein the second fluid passage is provided between the control apparatus and the control valve mechanism.

3. The oil pressure control apparatus according to claim 1, wherein the second fluid passage is provided for selectively changing the relative rotational phase of the driven side rotation member relative to the driving side rotation member to an advancing angle side and a retarded angle side.

4. The oil pressure control apparatus according to claim 1, wherein the movable member is movable to a position at which the opening formed on the movable member fully opens the third fluid passage when the control valve mechanism is set to a state for maximally supplying the oil to the second fluid passage.

5. The oil pressure control apparatus according to claim 2, wherein the movable member is movable to a position at which the opening formed on the movable member fully opens the third fluid passage when the control valve mechanism is set to a state for maximally supplying the oil to the second fluid passage.

6. The oil pressure control apparatus according to claim 2, wherein the control valve mechanism is maintained at a state for maximally supplying the oil to the second fluid passage when the oil temperature is lower than a predetermined first set temperature.

7. The oil pressure control apparatus according to claim 3, wherein the control valve mechanism is maintained at a state for maximally supplying the oil to the second fluid passage when the oil temperature is lower than a predetermined first set temperature.

8. The oil pressure control apparatus according to claim 4, wherein the control valve mechanism is maintained at a state for maximally supplying the oil to the second fluid passage when the oil temperature is lower than a predetermined first set temperature.

9. The oil pressure control apparatus according to claim 5, wherein the control valve mechanism is maintained at a state for maximally supplying the oil to the second fluid passage when the oil temperature is lower than a predetermined first set temperature.

10. The oil pressure control apparatus according to claim 2, wherein the control valve mechanism is maintained at a state for maximally supplying the oil to the second fluid passage when the oil temperature is higher than a predetermined second set temperature.

11. The oil pressure control apparatus according to claim 3, wherein the control valve mechanism is maintained at a state for maximally supplying the oil to the second fluid passage when the oil temperature is higher than a predetermined second set temperature.

12. The oil pressure control apparatus according to claim 4, wherein the control valve mechanism is maintained at a state for maximally supplying the oil to the second fluid passage when the oil temperature is higher than a predetermined second set temperature.

13. The oil pressure control apparatus according to claim 5, wherein the control valve mechanism is maintained at a state for maximally supplying the oil to the second fluid passage when the oil temperature is higher than a predetermined second set temperature.

14. The oil pressure control apparatus according to claim 1, wherein the fluid passage dimension regulating mechanism includes a cylindrical spool having a wall portion on which the opening is formed and being configured to receive the oil of the third fluid passage via the opening, a retainer having a cup shape for slidably retaining an end portion of the spool therewithin at a side away from the third fluid passage, and a biasing member pressing the spool to a bottom portion of the retainer;

the spool includes a first pressure receiving dimension to which the oil pressure from the third fluid passage is applied to move the spool in a biasing direction of the biasing member and a second pressure receiving dimension to which the oil pressure from the third fluid passage is applied to move the spool in a direction opposite from the biasing direction of the biasing member; and wherein the second pressure receiving dimension is greater than the first pressure receiving dimension.

15. The oil pressure control apparatus according to claim 1, wherein the fluid passage dimension regulating mechanism includes a cylindrical spool having a wall portion on which the opening is formed and being configured to receive the oil of the third fluid passage via the opening, a retainer having a cup shape for slidably retaining an end portion of the spool therewithin at a side away from the third fluid passage, and a biasing member pressing the spool to a bottom portion of the retainer;

the spool includes a pressure receiving portion to which the oil pressure of the third fluid passage is applied in a direction to be separated from the bottom portion of the retainer; and wherein the oil pressure of the fourth fluid passage is applied to a surface of the bottom portion of the retainer at an opposite side from the spool.

16. The oil pressure control apparatus according to claim 1, wherein the fluid passage dimension regulating mechanism includes a cylindrical spool having a wall portion on which the opening is formed and being configured to receive the oil of the third fluid passage via the opening, a retainer having a cup shape for slidably retaining an end portion of the spool therewithin at a side away from the third fluid passage, and a biasing member pressing the spool to a bottom portion of the retainer;

the bottom portion of the retainer includes a third pressure receiving dimension to which the oil pressure of the third fluid passage is applied to move the retainer in a biasing direction of the biasing member and a fourth pressure receiving dimension to which the oil pressure of the fourth fluid passage is applied to move the retainer in a direction opposite from the biasing direction of the biasing member;

an addition of a biasing force of the biasing member and a force generated by the application of the oil pressure of the third fluid passage to the third pressure receiving dimension is defined as a first pressure force, a force generated by the application of the oil pressure of the fourth fluid passage to the fourth pressure receiving dimension is defined as a second pressure force, and wherein a magnitude relation of the first pressure force and the second pressure force is reversed in response to a level of the oil pressure of an oil discharged from the pump.

17. An oil pressure control apparatus, comprising:

a pump driven by a rotation of a driving power source for discharging an oil;

an oil pressure actuator driven by a hydraulic pressure of the oil discharged from the pump;

a control valve mechanism being in communication with the pump via a first fluid passage and being in communication with the oil pressure actuator via a second fluid passage to control a supply and discharge of the oil relative to the oil pressure actuator;

a third fluid passage diverging from the first fluid passage to supply the oil to a predetermined portion other than the oil pressure actuator; and a fluid passage dimension regulating mechanism including a movable member configured to regulate a fluid passage dimension of the third fluid passage; wherein the movable member moves towards a side for increasing the fluid passage dimension of the third fluid passage by an application of at least one of the hydraulic pressure of the third fluid passage and the hydraulic pressure of the fourth fluid passage diverged from the second fluid passage.

* * * * *